United States Patent [19]

Oswald et al.

[11] 4,157,604

[45] Jun. 12, 1979

[54] METHOD OF HIGH SPEED YARN TEXTURING

[75] Inventors: Hendrikus J. Oswald, Morristown; Hsin L. Li, Parsippany; Russell H. Butler, Rockaway; Alfred L. Liland, Lake Shawnee, all of N.J.

[73] Assignee: Allied Chemical Corporation, Morris Township, Morris County, N.J.

[21] Appl. No.: 853,006

[22] Filed: Nov. 18, 1977

[51] Int. Cl.[2] ..... D02G 1/12

[52] U.S. Cl. ..... 28/221; 28/256; 28/265; 264/290 T

[58] Field of Search ..... 28/256, 257, 258, 254, 28/267, 265, 268, 220, 221; 264/290 T

[56] References Cited

U.S. PATENT DOCUMENTS

| | | | |
|---|---|---|---|
| 2,686,339 | 8/1954 | Holt | 28/221 |
| 3,372,446 | 3/1968 | Shichman et al. | 28/256 |
| 3,441,989 | 5/1969 | Clarkson et al. | 28/256 |
| 3,946,468 | 3/1976 | Satterwhite | 28/258 X |
| 4,024,610 | 5/1977 | Li et al. | 28/257 |
| 4,030,169 | 6/1977 | Enneking et al. | 28/265 |

*Primary Examiner*—Louis Rimrodt
*Attorney, Agent, or Firm*—Robert A. Harman

[57] ABSTRACT

Multifilament thermoplastic synthetic yarn is textured by an improved process involving propelling the yarn through an energy tube by superheated steam to strike, at an oblique angle, an unyielding barrier within a chamber in which the yarn then forms a plug on a moving perforate surface. The improvement comprises heat-setting the yarn, before the texturing operation, at constant length to the point that its density increases to at least 50% of the difference between that of undrawn amorphous yarn and the maximum normally attainable in such yarn; and feeding the resulting yarn hot into the energy tube whereby tendency toward shrinkage of the yarn resulting from undergoing crimping is reduced, and/or a higher texture level is obtainable at given temperature of the crimping operation.

5 Claims, 5 Drawing Figures

Y
1
2
3
4
5
6
7
8
9
10
11
12
13
Z
θ

METHOD OF HIGH SPEED YARN TEXTURING

BACKGROUND OF THE INVENTION

This invention relates to a continuous high speed process for texturing of thermoplastic synthetic fiber, especially texturing multifilament yarn to exceptionally high crimp levels. A particular feature of this invention is that the yarn is dimensionally stabilized or "set" by heat, in advance of the crimping operation, to low levels of shrinkage. Another feature is that the texturing is fast enough to allow coupling with a high-speed yarn drawing operation in a continuous process.

It is broadly known to couple the drawing and texturing of multifilament thermoplastic synthetic yarns, in particular polyethylene terephthalate ("PET") yarns which have been partially oriented to a birefringent value of about 15–30% of that observed in the drawn yarn, and having appreciable but low crystallinity as indicated by density. See Textile Research Journal, Feb. 1975, pp. 112–117, article by O. L. Shealy and R. E. Kitson.

A particular method of texturing thermoplastic synthetic yarn at high speed is taught in the U.S. patent application of Li, Oswald and Liland, Ser. No. 675,353, filed Apr. 9, 1976, now U.S. Pat. No. 4,074,405, granted 2/21/78 for "Method and Apparatus For Texturing Yarn" and in U.S. Pat. Nos. 4,024,610 and 4,024,611, both of May 24, 1977 to the same Li, Liland and Oswald.

Such method involves advancing and plasticizing a drawn synthetic yarn such as PET yarn drawn over a hot plate between two pairs of heated godets. The yarn is aspirated through a tube, sometimes called an "energy tube" in this art, with hot compressible fluid such as superheated steam; then the yarn strikes with sharp impact, as it issues from the energy tube, at an oblique angle against an unyielding barrier such as a moving perforate (including mesh) surface (especially a wire screen) within a chamber having a stationary cover and an outlet in the cover. A plug of the yarn in the chamber results from allowing a major portion of the fluid to pass out practically immediately, as through the perforate moving surface, and from the relatively slow advancement of the yarn as it is conveyed to the outlet from the chamber on such moving surface, moving at lower linear velocity than that of the yarn issuing from the energy tube. If desired, the yarn can be preheated before entering the energy tube; and/or a further amount of hot fluid can be introduced into the chamber for purposes of setting the crimps.

Another texturing method also involves forwarding incoming yarn by use of hot fluid such as superheated steam, into a chamber with provision for release of steam but without provision for an initial sharp impact of the yarn with an unyielding barrier. Thus, in U.S. Pat. No. 3,438,101 of Apr. 15, 1969 to Le Noir et al. for "Process and Apparatus for Texturizing Yarn," steam forces yarn through a tube onto a revolving wire screen forming the bottom of a peripheral chamber around a revolving drum, which chamber is covered over by an endless belt which drives the drum. The yarn is crimped by impingement against yarn compacted in the revolving chamber. Also, U.S. Pat. No. 4,019,228 of Apr. 26, 1977 to Ozawa et al. teaches use of an ejection nozzle whereby superheated steam forces yarn at high speed into a rotating stuffing chamber, covered with a stationary cover and having a peripheral screen surface. This apparatus is said to allow coupling known drawing processes with the crimping apparatus of the invention (Col. 7, lines 27–43; FIG. 10; FIG. 11; Examples 3, 4 and 6–9). The patent teaches also use of a yarn preheater upstream of the nozzle, operating to enhance the heat setting of the crimps formed by use of the apparatus (Col. 7, lines 16–26, FIG. 9 and Example 2).

Also of interest is U.S. Pat. No. 3,739,056 of June 12, 1973 to E. F. Evans et al. for "Draw/Relax/Anneal Process for Polyesters." This patent teaches processing of undrawn, amorphous polyester (such as PET) fibers including steps of drawing in a spray of heated liquid, relaxing in a steam jet, annealing at constant length by passing over a series of heated rolls, passing through a cooling spray, and passing to a "crimper 58" (Col. 2, lines 8–28 and FIG. 1). An alternative to annealing rolls is a hot plate (Col. 2, lines 38–52 and FIG. 3). The purpose of the relaxing and annealing is to develop both good tenacity and good dyeability (Col. 2, line 53-Col. 3, line 28).

Also to be noted is U.S. Pat. No. 3,665,567 of May 30, 1972 to Clarkson for "Yarn Rebound Texturing Apparatus and Method." Yarn carried by steam through a tube, is crimped by being hurled out of the tube longitudinally against a foraminous surface, from which it rebounds and then drops into a heat-setting chamber. The yarn prior to passage through the tube, is drawn in a conventional manner between two pairs of heated godet rolls.

SUMMARY OF THE INVENTION

In accordance with the present invention, multifilament thermoplastic synthetic yarn such as especially polyethylene terephthalate and nylon of relatively low birefringence and relatively low density (partially oriented or undrawn yarn, as obtained in a melt spinning operation) is drawn to at least the natural draw ratio (at which no undrawn yarn segments remain in the yarn) with provision for advancing the drawn yarn, preferably without intervening windup, through a heat-setting zone, while heating the yarn at constant length, using at least sufficient heat and residence time to increase the yarn density and bring the density, compared to that of undrawn amorphous yarn, up to at least 50%, preferably at least 70% of the normally attainable density increase in such yarn. Then the resulting drawn, dimensionally stabilized ("set") yarn, preferably without any intervening cooling operation, is supplied hot into an energy tube, through which the yarn is carried by a hot compressible fluid stream, as in the above discussed U.S. patent application Ser. No. 675,353 and U.S. Pat. Nos. 4,024,610 and 4,024,611, at linear velocity of the yarn of at least 450 meters per minute (MPM), preferably at least 2500 MPM, to strike first, at an oblique angle, an unyielding barrier within a chamber.

The resulting yarn is conveyed toward the outlet of the chamber by moving surfaces, including a moving perforate surface, traveling at a lower linear velocity than that of the incoming yarn, such moving surfaces and a stationary cover providing the confining surfaces of the chamber.

In the chamber, a part of the compressible hot fluid entering with the yarn through the energy tube escapes immediately through the perforations at the point of impingement of the yarn upon the moving barrier. The remaining fluid blows the yarn away from the barrier, within the confines of the chamber. The yarn then collects in plug form downstream from the point of impingement upon the barrier. The moving surfaces convey the plug of yarn to the outlet from the chamber, where it is removed from the chamber and wound on a bobbin. The residual fluid which did not escape at the point of initial impingement upon the barrier is dissipated through the perforated surface, between the point of impingement and the plug.

It has been found in accordance with the present invention, that the above described step of heat-setting the incoming yarn — in advance of crimping it by the use of hot compressible fluid in a nozzle, a barrier which the yarn strikes, and a moving perforate surface to convey the yarn as a plug — favors lower shrinkage and less thickening of the individual filaments, better dyeing uniformity, and a higher texture level (measured by percent crimp or by percent crimp extension) than found, at the same feed velocity of yarn, when such advance heat-setting is less complete or is omitted; and can allow use of lowered temperatures in the crimping operations, if texture level need not be at a maximum.

BRIEF DESCRIPTION OF THE DRAWINGS

The invention will be more fully understood when reference is made to the following detailed description and the accompanying drawings in which.

DESCRIPTION OF PREFERRED EMBODIMENTS

Figures 1, 2:
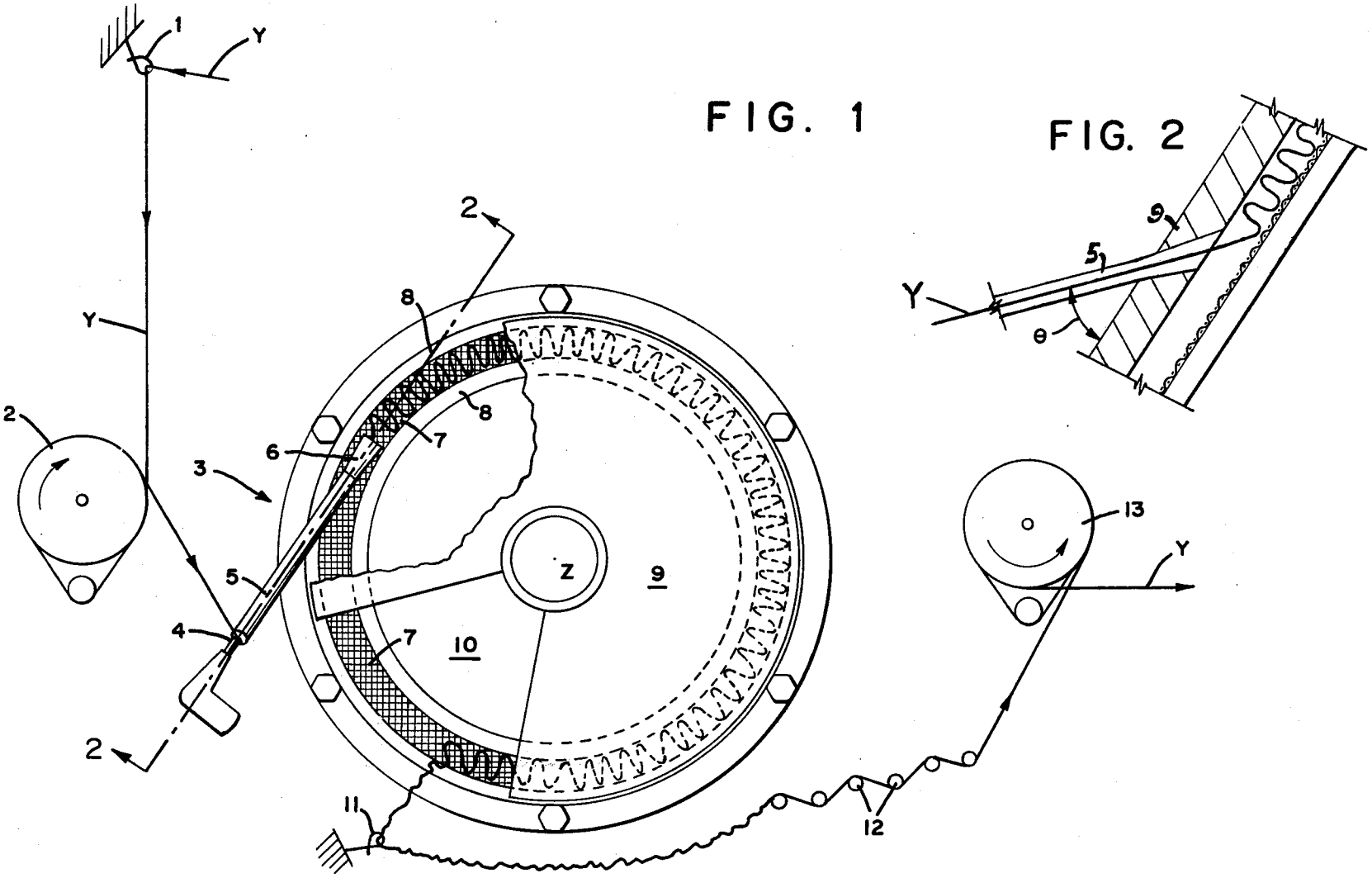
FIG. 1 is a diagrammatic plan view illustrating one form of texturing apparatus for carrying out the method of this invention.
FIG. 2 is a partial section along line 2—2 of FIG. 1.

Referring to the drawings, FIG. 1 shows yarn Y passing through ceramic guide 1 and traveling to heated godet 2. After passing in several wraps around the heated godet, so as to acquire the surface temperature of godet 2, the yarn is aspirated by steam directly by nozzle 4 into energy tube 5 of the crimping apparatus, generally designated 3. The crimping apparatus is of the type described in U.S. patent application Ser. No. 675,353 and U.S. Pat. Nos. 4,024,610 and 4,024,611 above cited. The tube 5 terminates in an expansion section 6 which preferably is shaped to discharge the yarn across the full width of screen 7. Screen 7 is in the form of a flat circular band, rotating about vertical axis Z; and forms the bottom of a chamber defined additionally by sidwalls 8, 8 and by cover 9. In the drawing, the cover 9 is shown broken away in the area where tube 5 passes through the cover, so as to show the yarn striking screen 7 and forming a plug spaced from the point of impingement on screen 7, as steam is discharged through the screen, and the yarn fills the chamber and piles up in a plug on the relatively slow-moving screen, as previously explained. (This plug is represented in FIG. 1 by back and forth loops but it is to be understood that these are symbolic only and do not display the actual structure of the yarn plug). Cover 9 includes a stationary circular tongue (not shown) snugly fitting down between the moving walls 8,8.

Cover 9 contains an outlet 10 therein, in the form of an open sector through which the yarn plug is released.

The steam entering the chamber is discharged through screen 7 and withdrawn by means not shown.

The yarn from outlet 10 is passed through a yarn guide 11 and over an assembly of tension bars 12, functioning to reduce tension on the hot, freshly crimped yarn, as would otherwise be imposed by takeup roll 13. The tension bars allow the force applied by the takeup roll to straighten the yarn without applying excessive tension to the crimped yarn upstream from the tension bars. Thereby the yarn is obtained in straightened form for winding, but retains its crimp in latent form which can be developed into a highly crimped form by application of heat and/or hot fluid as in scouring and dyeing operations and the like.

FIG. 2 depicts the angle, $\theta$, between tube 5 and cover 9 of the crimper 3 of FIG. 1.

Figure 3:
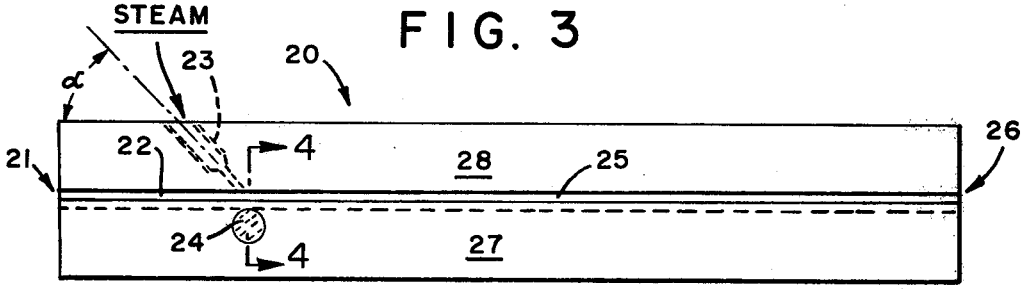
FIG. 3 is a diagrammatic elevation illustrating a steam jet device useful for the hot drawing and plasticization of yarn in accordance with the invention.

FIG. 3 illustrates a steam drawing and setting device suitable for use in this invention. The device is designated generally by the numeral 20. Yarn X (not shown) enters inlet 21 of plasticizing channel 22. A steam nozzle 23 meets channel 22 at an oblique angle ($\alpha$) pointing in the direction of yarn travel through channel 22. At the zone of impingement of the steam near the floor of channel 22, there is inserted in bottom piece 27 a removable ceramic pin 24 which serves to reduce the wear resulting from the sliding of yarn along the floor of channel 22. The yarn exits from the steam drawing-setting zone at exit 26.

Figure 4:
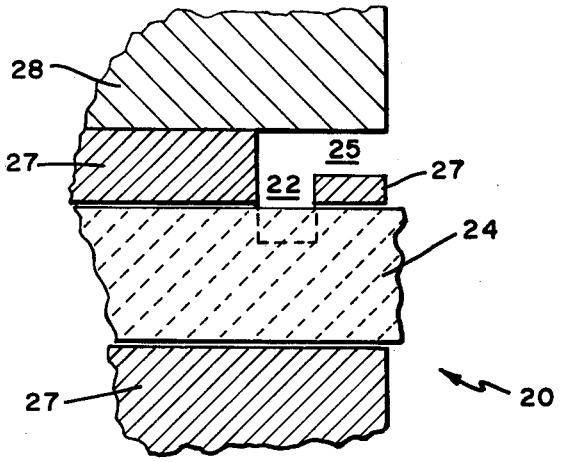
FIG. 4 is an enlarged view taken along line 4—4 of FIG. 3.

FIG. 4 is an enlarged view of a portion of the steam drawing-setting device 20 taken along the line 4—4 and showing in more detail the channel 22 and ceramic pin 24 inserted near the floor of the channel. Also shown is a groove 25 at the top of one side of channel 22, through which groove the yarn X can be inserted into channel 22.

Figure 5:
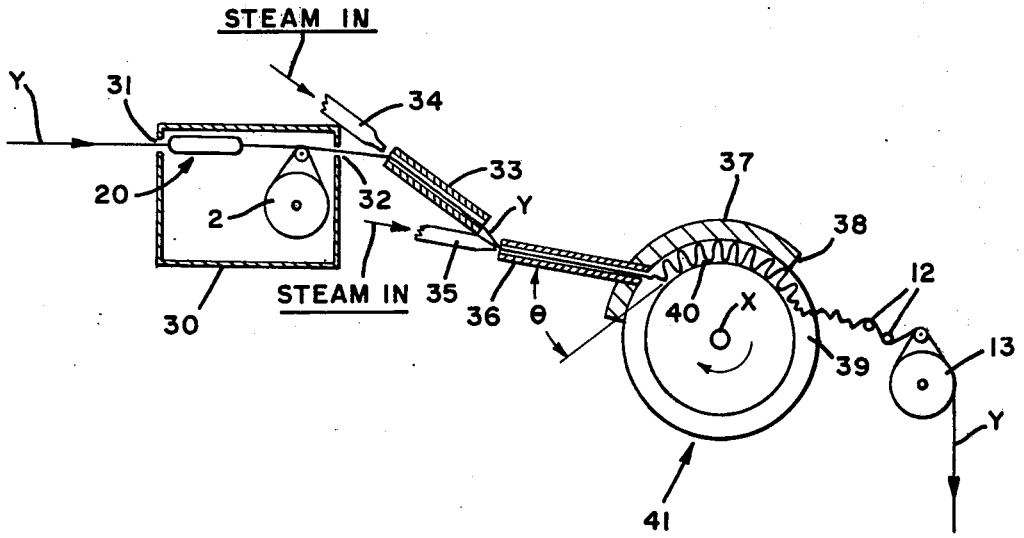
FIG. 5 is a diagrammatic vertical cross section illustrating an alternative texturing apparatus for carrying out the invention, instead of the apparatus shown in FIG. 1.

FIG. 5 illustrates in vertical cross-section, an alternative texturing apparatus for performing the invention in which yarn Y is shown entering an insulated box designated generally by the numeral 30. The yarn enters at opening 31 and passes through a steam drawing-setting device 20 such as illustrated in FIGS. 3 and 4. Then the yarn passes around heated godet 2, contained in the same insulated box 30 as the drawing-setting device 20. The resulting heat set yarn leaves the insulated box through an opening 32 and enters a preheater 33, suitably being carried therethrough and heated therein by steam from steam nozzle 34.

From the preheater the yarn is aspirated into energy tube 36 by steam from nozzle 35, and is propelled into a crimping apparatus 41 of a type described in the above-cited U.S. patent application Ser. No. 675,353 and U.S. Pat. Nos. 4,024,610 and 4,024,611. In this crimping apparatus the tube 36 is at an oblique angle, $\theta$, with the tangent to screen 40 at the point where the yarn from tube 36 meets the screen. Screen 40 in this form of apparatus is a cylindrical screen rotating about horizontal axis X. In this form of apparatus the crimping chamber is defined by moving screen 40 and a pair of moving sidewalls or lips 39 and a stationary cover 37. In the drawing of FIG. 5, one sidewall of box 30 and of crimper 41 are omitted and a section is taken through tubes 33 and 36 and through cover 37, to show the yarn passing through the apparatus. Cover 37 includes a tongue (not shown) snugly fitting between the sidewalls 39, 39.

The yarn is crimped and formed into a plug in this form of apparatus as a result of impingement upon the screen 40, escape of the fast flowing fluid through the screen, and relatively slow conveyance of the yarn by the moving screen and sidewalls to the outlet from the chamber, as previously explained. The yarn emerges from the chamber beyond the point 38 where stationary cover 37 terminates; and slides over tension bars 12 whence it is taken up by a takeup roll 13, as for the operations illustrated in FIG. 1.

DETAILED DESCRIPTION

In the tables which follow, the conditions used and the results obtained in specific embodiments of our invention, illustrative of the best mode contemplated by us for carrying out the invention, are shown. Tables 2 and 3 illustrate a preferred form of operation particularly applicable to fine denier yarns, in which the feed yarn is partially oriented yarn obtained in a melt spinning operation, and drawing and heat-setting are effected in contiguous zones under superheated steam.

Certain yarn properties listed in the tables were determined as follows:

(1) Linear % Shrinkage: 100 (Peripheral speed of feed godet — Peripheral speed of takeup godet)/(Peripheral speed of feed godet).

(2) Boil-off Shrinkage: Cut a 90 cm length of yarn; wrap in a cheese cloth bag; boil in water for 1 hour.

Remove from water bath; rinse; blot dry; hold for 24 hours under 50% relative humidity and 23° C. temperature; measure length L in cm.

$$\% \text{ Shrinkage} = 100(90-L)/90.$$

(3) Oven Shrinkage: Apply a load of 200 mg/denier* to a yarn; mark off a yarn segment of measured length $= L_0$.

*Denier = Mass of 90 cm of yarn, in grams, $\times 10^4$.

Hold the yarn for 10 minutes in air oven at 180° C. under no load.

Remove from oven; hold for 10 minutes under 50% relative humidity and 23° C. temperature.

Apply a load of 200 mg/denier; measure the previously marked yarn segment; new length = L.

$$\% \text{ Shrinkage} = 100(L_0 - L)/L_0.$$

(4) Percent crimp: Form a 12-inch long skein of 15 yarn wraps; hold for 5 minutes in air oven at 140° C. under load of 0.15 mg/denier (i.e. $0.15 \times 15 \times 2 \times$ denier = load in mg), to develop crimp.

Remove yarn from oven; hold for 5 minutes under 50% relative humidity and 23° C.

Apply load of 1.6 mg/denier; measure new skein length = L.

$$\% \text{ Crimp} = 100(12-L)/12.$$

(5) Crimps per inch: Determined by microscopic observation of number of bends per inch, along a stretched out length of yarn.

(6) Dye uniformity: By visual examination of dyed knitted sleeves.

(7) Crimp Extension After Steaming ("CEAS"): Form a 15-inch long skein of two yarn wraps; apply 0.16 mg/denier load; hold for 10 minutes in autoclave in saturated steam at 102° C. (215° F.), to develop crimp.

Remove from autoclave; hold for 2 hours under 50% relative humidity and 23° C.

Apply load of 1.6 mg/denier; measure length $= L_0$.

Apply load of 330 mg/denier; measure length = L.

$$\%\text{CEAS} = 100(L - L_0)/L_0.$$

TABLE 1-A (FIGS. 3 and 4)

Yarn: "POY" (partially oriented) PET (235 den./34 fil.) was hot drawn and set in the apparatus of FIGS. 3 and 4 at draw ratios of (a) 1.68, (b) 1.90.

Drawing Conditions

Steam pressure: 150 p.s.i.

Drawing speed (exit):1350 MPM (meters per minute)

Steam temperatures: selected values from 200° C. to 300° C.

Drawing/Heat-Setting Apparatus Characteristics (FIG. 3)

Angle ($\alpha$) of steam nozzle 23 pointing in direction of yarn travel: 45°

Inside diameter of steam nozzle: 0.041 inch

Length of channel 22: 6 inches

| Results (1-A) At draw ratio (a), (b) and steam temps in nozzles 23 | Boil-Off Shrinkage[1] yarn | | UTS g/den. yarn | | Yarn Density g/ml yarn | | % Increase In Density[2] yarn | |
|---|---|---|---|---|---|---|---|---|
| | (a) | (b) | (a) | (b) | (a) | (b) | (a) | (b) |
| 200° C. | 15% | 10% | 3.9 | 4.8 | 1.363 | 1.368 | 45 | 54 |
| 220° | 10 | 8 | 4.0 | 4.6 | 1.368 | 1.375 | 54 | 66 |
| 240° | 6 | 7.5 | 4.1 | 4.6 | 1.378 | 1.379 | 71 | 73 |
| 260° | 5 | 7 | 4.4 | 5.1 | 1.380 | 1.382 | 75 | 79 |
| 280° | 5 | — | 4.4 | 5.2 | 1.383 | 1.382 | 80 | 79 |
| 300° | 5 | — | 4.5 | 5.3 | 1.384 | — | 82 | — |

| Comparisons | Boil-Off Shrinkage | UTS g/d | Yarn Density |
|---|---|---|---|
| Partially-Oriented PET[3] | 60% | 2.2 | 1.341 |
| Undrawn Amorphous PET[3] | 44 | 1.2 | 1.338 |
| Drawn PET[3] | 8 | 4.3 | 1.380 |
| Drawn and textured PET[4] | 1 | 3.7–4.0 | 1.393–4 |

Notes:

[1]Se the above description of tests

[2]Percent increase in yarn density is calculated using the above comparisons, i.e. 1.338 for undrawn yarn and 1.394 as the normally attainable density.

[3]Per Text. Res. J., Feb. '75, p. 112;

[4]ibid. p. 116

Table 1-B (FIG. 1)

Yarn: Partially oriented PET hot drawn at draw ratio of 1.68 and set as per Table 1A at steam pressure of 150 p.s.i. and temperature of 270° C. to 152 den., was wound onto a supply bobbin, then textured in the apparatus of FIG. 1, using selected levels of heating of godet 2 and of temperatures of steam, entering nozzle 4.

(1) Apparatus Characteristics, Heat-Setting (FIG. 1)

Diam. of godet 2:6.2 inches

Wraps of yarn around godet 2: 11 wraps

Heat-Setting Conditions

Rate of travel of yarn from godet 2; 450 MPM

Contact time of yarn with godet 2: 0.7 sec:

Table 1-B-continued

| Surf. temp. of godet 2: | (a) no heat; | (b) 125° C.; | (c) 145° | (d) 165° |
|---|---|---|---|---|
| Results-Oven Shrinkage:(1) | (a) 10.5% | (b) 6.5 | (c) 5.5 | (d) 4.7 |

(yarn collected ahead of tube 5, without crimping)

Apparatus Characteristics Crimping, (FIG. 1)

Steam nozzle 4: 0.034 inch I.D.
Tube 5: 0.062 inch I.D. × 1.35 inch long; angle $\theta$ (FIG. 2) = 60°
Tube Outlet 6:
Width: 0.180 inch
Height: 0.030 inch
Circular screen 7 (200 lines per inch, 0.0021 inch diam. stainless steel wire):
Diam. at center line: 3.800 inches
Width: 0.200 inch
Cover 9 (a circular tongue fits snugly between walls 8,8):
Height of tongue above screen 7: 0.050 inch Crimping conditions Steam pressure entering nozzle 4: 135 p.s.i.
Steam temp. (°C.) of steam entering nozzle 4:
(a) 240°; (b) 260°; (c) 280°; (d) 300°; (e) 320°
Linear velocity of entering yarn: 450 MPM Results - Crimping

| Surf. Temp. (godet 2) | Steam Temp (nozzle 4) | Linear Shrinkage(1) | Final Denier(2) | % Crimp(3) | Textured Yarn Density |
|---|---|---|---|---|---|
| No heating | 240° C. | 23% | 197 | 28% | — |
| | 280° | 27 | 207 | 38 | — |
| | 300° | 35 | 233 | 37 | — |
| 125° C. | 240° | 13 | 174 | 24 | — |
| | 280° | 22 | 193 | 39 | 1.387g/ml |
| | 300° | 29 | 214 | 40 | 1.390 |
| 145° | 240° | 10 | 169 | 14 | — |
| | 260° | 11.5 | 172 | 27 | — |
| | 280° | 17 | 184 | 36 | — |
| | 300° | 27 | 207 | 38 | 1.391 |
| 165° | 240° | 11 | 171 | 8 | — |
| | 280° | 11 | 171 | 27 | — |
| | 300° | 17 | 184 | 36 | — |
| | 320° | 24 | 200 | 39 | 1.391 |

Notes (1), (2), (3)
See the above description of tests. In general at given crimp level (percent crimp), a relatively low linear percent shrinkage and denier is desirable since the resulting textured yarn retains more of its orientation; whence it shows, in general, better dye characteristics, and usually has better covering power in fabric, per unit weight of yarn.

Table 2

(FIG. 5)

Yarn: POY 235 den./34 fil. PET was hot drawn and set as per Table 1A using a drawing-setting steam zone as in FIG. 3, except extended to 12 inches length; and provided with an electrically heated steam manifold having three steam jets (hereinafter designated 23(a), 23(b), 23(c)) each at an angle of 30° pointing in the direction of yarn travel and spaced down channel 22, to accommodate the comparatively high processing speed employed (3400 MPM vs. 1350 MPM in Table 1A); then was further set using a heated godet immediately following the drawing-setting step. Then without an intervening cooling operation, the yarn was supplied hot, via a preheater, to an energy tube through which steam was flowed to propel the yarn at high speed to the crimping operation - as diagrammatically illustrated in FIG. 5.

Apparatus Characteristics, Drawing/Heat-Setting (FIG. 5)

Inside diameter of nozzles of the three steam jets (not shown) in drawing-setting device 20: 23 (a) 0.046 inch; 23 (b) 0.027; 23 (c) 0.027
Diam. of godet 2: 5.8 inches
Wraps on godet 2: 11

Drawing/Heat-Setting Conditions (FIG. 4)

Steam pressure: 100 p.s.i.g.
Steam Temp.: 270° C.
Yarn travel in drawing-setting device 20: 12 inches
Drawing speed (exit): 3400 MPM
Contact time of yarn with godet 2: 0.1 sec.
Draw ratio: (a) 1.7; (b) 1.9
Temp. setting for godet 2: (a) 115° C.; (b) 155° C.

Preheating Conditions (tube 33)

Steam pressure entering nozzle 34: 140 p.s.i.g.
Steam temp. entering nozzle 34: 250° C.

Apparatus Characteristics, Crimper 41 of FIG. 5

Table 2-continued

Steam nozzle 35: 0.049 inch I.D.
Tube 36: 0.095 inch I.D. × 5 inches long, with the outlet extension, into tongued cover 37, being 0.155 inch wide × 0.040 inch high and forming angle ($\theta$) of 55° with the tangent to the screen, at point of yarn impingement on the screen 40
Cover 37: extends 5 inches along screen 40
Cylindrical screen 40 (200 lines per inch, 0.0021 inch diam. stainless steel wire):
Diameter: 9 inches
Width: 0.200 inch
Height between screen 40 and tongue of cover 37: 0.050 inch Crimping Conditions Steam pressure entering nozzle 35: 130 p.s.i.g.
Steam temp. entering nozzle 35: various levels in the range from 232° C. to 315° C.
Linear velocity of entering yarn: 3400 MPM
Linear velocity of moving screen: 16-18 MPM Results (A) Draw ratio of 1.7; godet 2 set for 115° C.(5)

| Steam temp. (nozzle 35) | Wheel RPM | Linear % Shrink(1) | Final Denier(2) | % Crimp(3) | Textured Yarn Density | Dye Unif.(4) |
|---|---|---|---|---|---|---|
| 232° C. | 25.3 | 15.4% | 183 | 24% | — | good |
| 249° | 24.5 | 16.5 | 186 | 28 | — | " |
| 265° | 24.0 | 17.5 | 186 | 31 | — | " |
| 280° | 23.0 | 20.0 | 194 | 33 | 1.386g/ml | " |
| 299° | 23.0 | 21.8 | 208 | 38 | 1.387 | dark spots |
| 316° | 23.2 | 23.5 | 204 | 39 | 1.388 | " |

(B) Draw ratio of 1.7; godet 2 set for 155° C.(5)

| Steam temp. (nozzle 35) | Wheel RPM | Linear % Shrink(1) | Final Denier(2) | % Crimp(3) | Textured Yarn Density | Dye Unif.(4) |
|---|---|---|---|---|---|---|
| 260° C. | 25.0 | 15.0% | 181 | 38% | — | good |
| 263° | 24.3 | 16.0 | 186 | 36 | 1.387g/ml | " |
| 276° | 24.3 | 18.0 | 200 | 38 | 1.387 | dark spots |
| 293° | 23.6 | 21.0 | 197 | 40 | 1.389 | " |
| 302° | 23.0 | 23.2 | 213 | 38 | 1.389 | " |
| 310° | 23.0 | 24.3 | 207 | 41 | 1.390 | " |
| (C) Draw ratio of 1.9; godet 2 set for 115° C.(5) | | | | | | |
| 249° C. | 22.2 | 20.0% | 172 | 30% | — | good |
| 266° | 22.2 | 22.0 | 174 | 34 | 1.386g/ml | " |
| 282° | 22.2 | 24.0 | 180 | 36 | 1.385 | " |
| 299° | 22.2 | 25.8 | 188 | 39 | 1.386 | dark spots |
| 310° | 22.2 | 27.5 | 192 | 38 | 1.387 | " |
| (D) Draw ratio of 1.9; godet 2 set for 155° C.(5) | | | | | | |
| 237° C. | 23.0 | 15.3% | 164 | 32% | — | good |
| 249° | 22.7 | 17.0 | 167 | 36 | 1.386g/ml | " |
| 266° | 22.4 | 19.5 | 176 | 38 | 1.387 | " |
| 274° | 23.0 | 21.3 | 187 | 39 | 1.388 | " |
| 274° | 24.2 | 20.5 | 184 | 39 | 1.385 | dark spots |
| 282° | 22.4 | 23.5 | 181 | 39 | 1.388 | " |
| 291° | 22.4 | 25.8 | 185 | 40 | 1.389 | " |

Notes:
(1), (2), (3), (4)See the above description of tests.
(5)The actual temperature may be higher because the godet is in insulated box 30.

Table 3

(FIG. 5)

Yarn: POY (PET) den./fil. (a) 115/34; (b) 230/68; (c) 235/34 processed generally as per Table 2 (but omitting the preheater).
Apparatus, Drawing-Setting: As in Table 2 above.

Drawing/Heat-Setting Conditions

Steam pressure: 100 p.s.i.g.
Steam temperature: 274° C.
Yarn travel in drawing-setting device 20: 12 inches
Drawing speed (exit): 3130 MPM
Draw ratio: 1.7
Surf. temp.(5)of godet 2: yarn (a) 115° to 120° C., (b) 129° to 132° C., (c) 115° to 120° C.

Apparatus, Crimping (FIG. 5) - As for Table 2 except yarn passes immediately from insulated box 30 into energy tube 36.
Length of cover 37 to the left of tube 36: 0.75 inch
Length of cover 37 to the right of tube 36: 3-11/16 inches Crimping Conditions Steam entering nozzle 35:
Yarn (a) pressure 70 p.s.i.g.

Table 3-continued temp. 287° C.
Yarn (b) pressure 90 p.s.i.g.
temp. 283° C.
Yarn (c) pressure 130 p.s.i.g.
temp. 269° C.
Linear velocity of entering yarn (a), (b), (c): 3130 MPM
Linear velocity of moving screen:
For yarn (a) above: 12.5 MPM; yarn (b): 22.3; yarn (c): 16.2
Pressure of steam above point of impingement of yarn on screen:
For yarn (a) above: 0.29 to 0.005 p.s.i.g.; yarn (b): 0.06 to 0.58; yarn (c): 0.05
Wheel RPM of crimper 41
For yarn (a) above: 17.3; yarn (b): 31.0; yarn (c): 22.5

Results

| Yarn | Linear % Shrink(1) | Final Denier(2) | % Crimp(3) | Crimps per inch(4) | Textured Yarn Density |
|---|---|---|---|---|---|
| (a) | 19% | 83-90 | 32% | 53 | 1.389g/ml |
| (b) | 17 | 165-175 | 31 | 49 | — |

Table 3-continued

| | | | | | |
|---|---|---|---|---|---|
| (c) | 16 | 169–180 | 31 | 43 | — |

Notes: (1), (2), (3), (4), (5) - See Notes for Table 2 above.

From the crimping results set out in Table 1B above, it can be seen that generally lower levels of shrinkage were obtained for a given percent crimp, when higher heat-setting temperatures were employed.

In accordance with the results of Table 2, given steam temperatures in the energy tube 36 produced higher levels of percent crimp at both draw ratios, when the temperature-setting of godet 2 was at 155° C. (especially at the lower energy tube steam temperatures). Moreover, such higher temperatures at godet 2 generally were associated with lower linear shrinkage at any given crimp level.

A combination of conditions is shown at which linear percent shrinkage is about 16%–20% and percent crimp is about 36%–38%, and dye uniformity is good as shown by absence of dark spots in the dyeing uniformity test.

Table 3 shows that a high crimp level, in terms of number of crimps per inch, is obtainable in accordance with this invention.

Particularly preferred conditions for use in texturing operations as above described starting with partially oriented PET yarn, to obtain textured yarn of apparel denier, comprise drawing the yarn at about 1.65 to 2.0 draw ratio in a zone heated by superheated steam, heated to temperature in the range from 235° C. to 300° C.; supplying the drawn feed yarn directly, without winding up, at linear velocity of at least 2500 MPM to a heat-setting operation in a contiguous zone wherein heat-setting is effected by contact between the yarn and superheated steam as above, using at least sufficient residence time to bring the yarn density to at least 1.378 g./ml.; and crimping the resulting heat-set yarn at steam temperature from 250° C. to 300° C.

The following Tables 4 and 5 illustrate use, in accordance with this invention, of nylon yarn.

Partially oriented polycaproamide nylon yarn (80 initial denier, 18 filament) was cold drawn at drawn ratio of 1.2 and heat-set, and was supplied hot to a texturing operation, by passing around a heated feed godet and thence to a crimper as illustrated in the accompanying FIG. 5, reference numeral 41. Steam entering nozzle 35 was at 130 p.s.i.g. and 275° C. Conditions used and results are outlined in Table 4.

Table 4

(Crimper 41 of FIG. 5)

| | Surf. Temp. of Feed Godet | RPM Wheel | Linear % Shrink(1) | Final Denier(2) | % Crimp(3) |
|---|---|---|---|---|---|
| (a) | 100° C. | 35.5–36.0 | 14.5 | 75 | 32 |
| | 100 | 34.0–34.2 | 16.0 | 72 | 35 |
| | 100 | 32.0–32.5 | 19.5 | 75 | 41 |
| (b) | 112 | 35.5–36.0 | 13.0 | 72 | 34 |
| | 112 | 34.0–34.2 | 14.5 | 76 | 35 |
| | 112 | 32.0–32.5 | 16.0 | 73 | 41 |
| (c) | 125 | 35.5–36.0 | 14.0 | 71 | 37 |
| | 125 | 34.0–34.2 | 16.5 | 72 | 41 |
| | 125 | 32.0–32.5 | 19.5 | 74 | 42 |
| (d) | 135 | 35.5–36.0 | 13.5 | 75 | 38 |
| | 135 | 34.0–34.2 | 16.0 | 72 | 40 |
| | 135 | 32.0–32.5 | 22.0 | 72 | 46 |

Notes: (1), (2), (3) - See the above description of tests.

Table 5

(Crimper 41 of FIG. 5)

Yarn: Undrawn polycaproamide nylon yarn (3200 initial denier, 70 filament) after cold drawing at draw ratio of 3.0 and heat-setting, was supplied hot to a texturing operation by passing around a heated feed godet and then to a crimper as illustrated in the accompanying FIG. 5, reference numeral 41.

Apparatus Characteristics, Crimping (Crimper 41 of FIG. 5)

Steam nozzle 35: 0.070 inch I.D.
Tube 36: 0.150 inch I.D. × 5 inches long, with the outlet extension, into tongue cover 37, being 0.432 inch wide × 0.082 inch high and forming angle ($\theta$) of 60° with the tangent to the screen, at point of yarn impingement on the screen 40
Cover 37: extends 5 inches along screen 40
Cylindrical screen 40 (90 lines per inch, 0.0035 inch diameter stainless steel wire):
Diameter: 9 inches
Width: 0.500 inch
Height between screen 40 and tongue of cover 37: 0.100 inch Heat-Setting and Crimping Conditions Wraps around heated godet: 8
Surface temp. of heated godet: Tabulated below under "Results"
Linear velocity of entering yarn: 3060 MPM
Linear velocity of moving screen 40: 46–50 MPM
Steam pressure entering nozzle 35: 115 p.s.i.g.
Steam temp. entering nozzle 35: Tabulated below under "Results".

Results

| Surf. temp. of Heated Godet | Steam Temp. Nozzle 35 | Wheel RPM | Linear % Shrink(1) | Percent "CEAS"(2) | Yarn Dens. Before Texturing (g/ml) | Percent Increase In Density(3) |
|---|---|---|---|---|---|---|
| 170° C. | 262° C. | 66 | 14.5 | 23.6 | | |
| | 278 | 66 | 16.0 | 24.6 | | |
| | 289 | 64 | 17.5 | 25.4 | ca.1.140 | 77 |
| | 296 | 64 | 18.0 | 23.9 | | |
| | 304 | 64 | 19.1 | 28.8 | | |
| | 316 | 64 | 20.0 | 26.4 | | |

Table 5-continued

| | | | | | | |
|---|---|---|---|---|---|---|
| 180° C. | 264 | 68 | 14.0 | 29.1 | | |
| | 279 | 68 | 15.5 | 26.8 | | |
| | 288 | 70 | 15.8 | 29.4 | 1.141 | 83 |
| | 299 | 70 | 16.5 | 31.5 | | |
| | 304 | 70 | 17.0 | 29.3 | | |
| | 310 | 70 | 17.3 | 29.4 | | |
| | 316 | 70 | 18.3 | 32.2 | | |

Notes:
(1), (2) - See the above description of tests.
(3) - Calculated as percent of the difference between highest density observed in the final yarn (1.144 g/ml) and density of a quenched undrawn filament (1.127g/ml).

The nylon yarn (d) of the above Table 4, which underwent the highest of the four godet temperatures (135° C.), showed the highest crimp level for given Linear Percent shrink. The heavy denier yarn of Table 5 showed higher crimp levels (CEAS) and lower linear Percent Shrink for given tmperature in energy tube 36, when heat-set at the higher of the two temperature (180° C. vs. 170° C.).

It will be recognized that by virtue of the high speed of drawing yarn and of then texturing the yarn without intervening windup, obtainable in accordance with the present invention, it becomes possible using this invention to melt spin, draw, heat-set and texture a thermoplastic synthetic yarn in uninterrupted, continuous sequence at high speeds in all steps, such as at least 2500 MPM feed to the texturing operation, without intervening windup.

We claim:

1. In a process of texturing multifilament polyethylene terephthalate partially oriented apparel yarn, by crimping operations comprising carrying drawn yarn by a stream of hot steam through an energy tube at high linear velocity to strike first, at an oblique angle, an unyielding barrier within a covered chamber which includes a perforate moving confining surface; allowing the compressible fluid to escape through the perforations in the moving surface; conveying the yarn toward the outlet from the chamber on said surface, traveling at lower linear velocity than that of the incoming yarn, whereby the yarn collects in a plug downstream from the point of impingement of the yarn with the barrier; and removing the yarn from the chamber when the plug reaches the outlet from the chamber:

the improvement which comprises, in combination, drawing said yarn in steam, heated to temperature in the range from 235° C. to 300° C., at draw ratio in the range from 1.65 to 2.0; heat-setting the yarn in drawn state, by contact between the yarn and such heated steam using at least sufficient total heat and residence time to bring the density of the resulting heat-set yarn to at least 1.378 g./ml., followed by heating the yarn at constant length — in advance of subjecting it to the above recited crimping operations — by passing the yarn around a heated roll at contact time of about 0.1 second, said roll being heated to temperature of about 145° to 165° C.; and supplying the resulting hot, dimensionally stabilized yarn directly, without winding up, at linear velocity of at least 2500 meters per minute, into the energy tube for the above crimping operations.

2. Process of claim 1 wherein the drawn and heat-set yarn is passed by the heated roll into a tube wherein it contacts steam heated to about 250° C., immediately prior to entering the energy tube.

3. Process of claim 2 wherein the crimping operation is effected with the use of steam temperature from 250° C. to 300° C. whereby the yarn has linear percent shrinkage not above 20% and has percent crimp of at least 36%, and shows no dark spots in the dyeing uniformity test.

4. Process of claim 2 wherein the texturing is coupled with the yarn drawing operation in a continuous process.

5. Process of claim 4 wherein the melt spinning, drawing, and texturing of the yarn are carried out in uninterrupted, continuous sequence without intervening windup.

* * * * *